US008973177B2

(12) United States Patent
Bates

(10) Patent No.: US 8,973,177 B2
(45) Date of Patent: Mar. 10, 2015

(54) DROP-IN BATH WITH INTEGRAL HANDGRIPS

(75) Inventor: Michael R. Bates, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 501 days.

(21) Appl. No.: 12/758,618

(22) Filed: Apr. 12, 2010

(65) Prior Publication Data

US 2011/0214230 A1 Sep. 8, 2011

Related U.S. Application Data

(60) Provisional application No. 61/311,236, filed on Mar. 5, 2010.

(51) Int. Cl.
*A47K 3/02* (2006.01)
*A47K 3/00* (2006.01)

(52) U.S. Cl.
CPC .. *A47K 3/02* (2013.01); *A47K 3/003* (2013.01)
USPC ..... 4/584

(58) Field of Classification Search
CPC ..... A47K 3/02; A47K 3/03; A47K 3/16; A47K 3/04; A47K 3/1605; A47K 3/008
USPC ..... 4/484, 584, 592, 576.1, 595, 546, 548, 4/549, 593, 641, 589; D23/280.1, 280.2, D23/277
See application file for complete search history.

(56) References Cited

U.S. PATENT DOCUMENTS

| | | | |
|---|---|---|---|
| D22,809 | S | 9/1893 | Dawes |
| D24,777 | S | 10/1895 | Marschuetz |
| D24,889 | S | 11/1895 | Marschuetz |
| 921,733 | A | 5/1909 | Pugh |

(Continued)

FOREIGN PATENT DOCUMENTS

| | | |
|---|---|---|
| DE | 3042037 | 11/1980 |
| GB | 661507 | 11/1951 |

(Continued)

OTHER PUBLICATIONS

Notice of Allowance and Fees Due for U.S. Appl. No. 29/331,593; Dec. 24, 2009.

(Continued)

*Primary Examiner* — Huyen Le
*Assistant Examiner* — Janie Christiansen
(74) *Attorney, Agent, or Firm* — Foley & Lardner LLP

(57) ABSTRACT

A drop-in mounted bath tub has a peripheral rim that is uniquely shaped to both support the tub on a mounting platform and provide integral handgrips used to assist the bather in entering and exiting the tub. The rim curves out from the top of the basin downward toward the mounting platform. The rim extends down further at the end walls of the basin than at the side walls so that it contacts the mounting platform only at the end walls while being spaced up from the mounting platform at the sides. The contoured rim provides a stable, comfortable surface for the bather to grasp. One or more partition walls extending from the rim between the basin side walls and the outer edge of the rim provides for sealing the basin to the mounting platform as well as keeping items from falling between the tub and the mounting platform and preventing the bather from touching or viewing the rough unfinished outer shell of the basin.

19 Claims, 2 Drawing Sheets

(56) References Cited

U.S. PATENT DOCUMENTS

| | | | | | |
|---|---|---|---|---|---|
| 1,159,395 | A | | 11/1915 | Kohler | |
| 1,161,137 | A | * | 11/1915 | Lane | 4/589 |
| 1,290,736 | A | | 1/1919 | Greenberg | |
| 1,329,487 | A | | 2/1920 | West | |
| D56,879 | S | | 1/1921 | Jones | |
| 1,775,301 | A | | 9/1930 | Wiebmer | |
| 1,849,346 | A | * | 3/1932 | Cromwell | 4/595 |
| 1,960,830 | A | * | 5/1934 | Saxman | 4/589 |
| 1,980,929 | A | * | 11/1934 | Potter | 4/589 |
| 2,005,576 | A | * | 6/1935 | Buhl et al. | 4/577.1 |
| 2,269,420 | A | | 1/1942 | Anderson et al. | |
| 2,436,903 | A | * | 3/1948 | Schafer | 4/589 |
| 2,464,645 | A | | 3/1949 | Lassa | |
| 2,836,834 | A | | 6/1958 | Tisdall | |
| 2,885,690 | A | | 5/1959 | Scott | |
| D185,357 | S | | 6/1959 | Furiness | |
| 3,098,240 | A | | 7/1963 | Fleenor | |
| 3,414,910 | A | | 12/1968 | Provi et al. | |
| D228,133 | S | | 8/1973 | Lippert | |
| D235,105 | S | | 5/1975 | Doman | |
| D250,830 | S | | 1/1979 | Clement | |
| 4,149,282 | A | | 4/1979 | Browning et al. | |
| D282,963 | S | | 3/1986 | Alger | |
| 5,659,904 | A | | 8/1997 | Doczy et al. | |
| D482,763 | S | | 11/2003 | Thomas | |
| D501,246 | S | | 1/2005 | Reid et al. | |
| D526,054 | S | * | 8/2006 | Lebrun et al. | D23/280.1 |
| D527,083 | S | | 8/2006 | Lebrun et al. | |
| D530,402 | S | | 10/2006 | Soulier | |
| 2009/0211018 | A1 | | 8/2009 | Meyers et al. | |

FOREIGN PATENT DOCUMENTS

| | | | |
|---|---|---|---|
| JP | 8182631 | A | 7/1996 |
| JP | 10127510 | A | 5/1998 |
| JP | 2000051110 | A | 2/2000 |
| JP | 2000354554 | A | 12/2000 |

OTHER PUBLICATIONS

Kohler Co. "Tableau® wall-mount lavatory". Model No. K-14293. Kohler Co. online catalog. Copyright 2009 Kohler Co.

Kohler Co. "Kathryn 5.5' Bath with Integral Tile Flange and Right-Hand Drain". Model No. K-804-R. Kohler Co. online catalog. Copyright 2009 Kohler Co.

International Preliminary Examination Report and Written Opinion for International Application No. PCT/US2011/027073 dated Sep. 11, 2012; 5 pages.

European Search Report regarding Application No. 11751377.0 dated Nov. 24, 2014.

* cited by examiner

DROP-IN BATH WITH INTEGRAL HANDGRIPS

CROSS-REFERENCE TO RELATED APPLICATION(S)

This application claims priority to U.S. Design patent application No. 29/331,593, filed on Jan. 28, 2009, issuing as D613,833 on Apr. 13, 2010, and claims priority to U.S. Provisional Application No. 61/311,236, filed on Mar. 5, 2010.

STATEMENT OF FEDERALLY SPONSORED RESEARCH OR DEVELOPMENT

Not applicable.

BACKGROUND OF THE INVENTION

The present invention relates to plumbing fixtures, such as bath tubs. More specifically, the invention relates to bath tubs having integrally formed structures for assisting bathers into and out of the tub basins.

To prevent slipping, it is common for bath tubs to have features for bathers to grasp when stepping into and out of the tub. Handles, or other bar-like components, are typically mounted to the side walls of the tub basin to give the bather a structure that can be grasped readily. See e.g., U.S. Pat. No. D282,963. Handles and the like are usually made of an easily formed or molded material, such as plastic or metal, rather than vitreous, fiberglass or such materials from which the tub basins are formed. Such handles are thus separate components that must be assembled to the tub basin with mechanical fasteners, such as screws, bolts, rivets, clips adhesives and the like, which add to the cost and complexity of the manufacturing and assembling of the bath tub. Moreover, handles, and associated mounting hardware, are primarily functional components and thus often detract from the overall aesthetic of the bath tub. Furthermore, the seams at the interface of the handles and the tub basin can create areas for leakage and otherwise make cleaning more difficult.

For bath tubs without handles, a bather must use nearby objects, such as walls, countertops and the like, or the side walls of the tub itself for support when entering and exiting the bath tub. In drop-in mounted tubs there is typically a flat ledge at the periphery of the tub basin that the bather sits on or presses against to aid in getting in and out of the bath tub. In free-standing tubs, the thin side walls of the tub basin are typically contoured and curve out along the periphery of the tub basin. See e.g. U.S. Pat. Nos. D22,809; D24,777 and D24,889. Both the wide, flat ledges of typical drop-in bath tubs and the thin, curved walls of typical free-standing tub are difficult for the bather to grasp securely and comfortably. To help in the latter case, the prior art teaches using a cover or wrap, such as made of rubber or metal, that fits over the curved rim of the bath tub so that it may be grasped more readily. See U.S. Pat. Nos. 921,733 and 1,329,487. However, such wraps detract from the aesthetic appearance of the tub and provide more items that must be assembled and cleaned.

Drop-in mounted tubs provide additional concerns. Namely, as mentioned, they typically have a wide ledge at the periphery of the tub basin, which sits flush atop a mounting platform. The large width and flush mounting of the ledge makes it unsuitable for grasping within a bather's hands. Moreover, if the tubs are not flush-mounted, then there may not be an area for sealing the tub basin to the mounting platform, such that water could leak down around the tub basin within the mounting platform. Even if an adequate seal could be established between the tub basin and the mounting platform with the ledge being spaced off the mounting platform sufficient to allow a bather's fingers to fit into, small items could fall into this space and possibly down between the tub basin and the mounting platform, and dirt could accumulate there as well.

Therefore, the prior art does not provide a bath tub with structures integrally formed with the tub basin that may be readily grasped by bathers, and which may be used in the drop-in mounting applications without leaving gaps between the tub basin and the mounting surface.

SUMMARY OF THE INVENTION

The present invention provides a drop-in mounted bath tub that has a basin with a peripheral rim that is uniquely shaped to both support the tub on a mounting platform and provide integral handgrips used to assist the bather in entering and exiting the tub. The rim can curve out from the top of the basin downward toward the mounting platform further at the end walls of the basin than at the side walls so that it contacts the mounting platform only at the end walls while being spaced up from the mounting platform at the sides. The contoured rim provides a stable, comfortable surface for the bather to grasp. A partition wall can be provided which extends from the rim between the basin side walls and the outer edge of the rim to provide a surface for sealing the basin to the mounting platform as well as a guard to keep items from falling between the tub and the mounting platform and to prevent the bather from touching or viewing the rough, unfinished outer shell of the basin.

In particular, in one aspect the invention is a tub for bathing having a basin including a bottom, upright side walls and upright foot and head end walls. A rim extends down from the side walls and the foot and head end walls. At least a portion of the rim extends to a first height at each of the foot and head end walls and at least a portion of the rim extends to a second height at each of the side walls, wherein the first height is less than the second height with respect to a base plane, such as that including the floor or the basin bottom.

In another aspect, the invention provides a tub for bathing capable of being drop-in mounted to a mounting platform. The tub has a basin formed of a bottom, upright side walls, and upright end walls. A rim extends from a top of the basin to a peripheral edge. A partition wall extends from the rim between the basin side walls and the rim peripheral edge. The partition wall extends to a height that is closer to the basin bottom than that of at least a portion of the rim peripheral edge.

Yet another aspect of the invention provides a tub for bathing capable of being drop-in mounted to a mounting platform with a basin having a peripheral rim and a partition as described. However, the rim is shaped so that when the tub is mounted to the mounting platform the peripheral edge of the rim contacts the mounting platform at the end walls and is spaced from the mounting platform at the side walls so as to provide contoured handgrips that are integral with the tub along the sides to assist the bather into and out of the tub basin.

These and other advantages of the invention will be apparent from the detailed description which follows and accompanying drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF EXEMPLARY EMBODIMENT(S)

Figure 1:
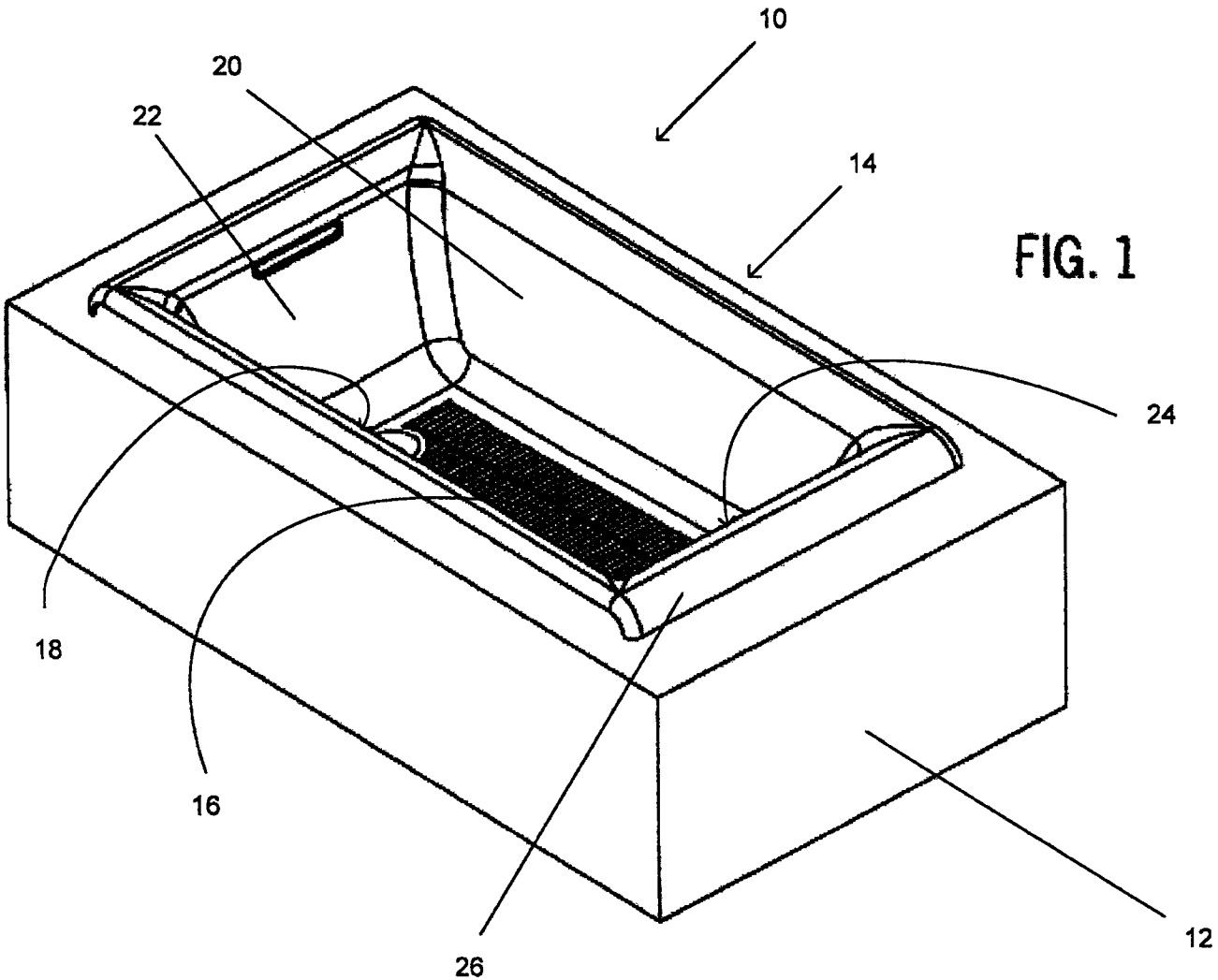
FIG. 1 is an isometric view of a bath tub embodying the invention that is drop-in mounted in an opening of a mounting platform.

The present invention provides an improved bath tub 10 that can be drop-in mounted at an opening (not shown) in a mounting platform 12 as seen in FIG. 1. Specifically, the bath tub 10 has a basin 14 with a bottom defined by bottom wall 16 and opposite sides defined by side walls 18 and 20 and opposite ends defined by head 22 and foot 24 walls. The side walls 18 and 20 and end walls 22 and 24 extend up from the bottom wall 16 and have upper edges that curve outward to form a peripheral rim 26. The walls 16-24 and rim 26 thus form a continuous, monolithic basin structure without joints or seams.

Figure 2:
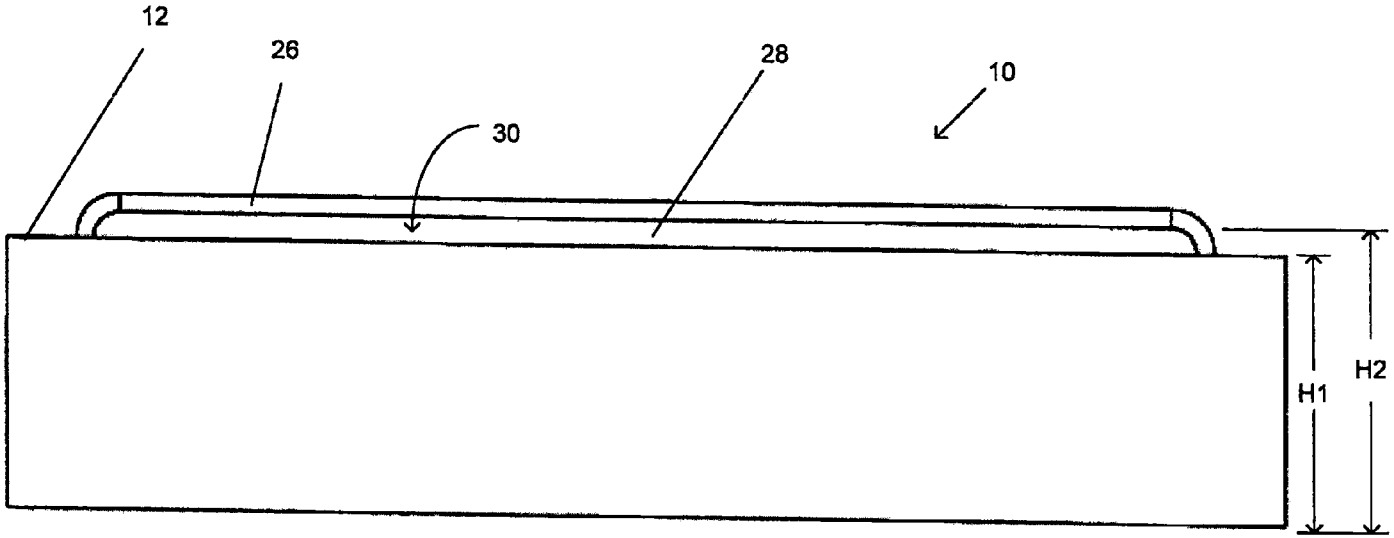
FIG. 2 is a side elevation view thereof.
Figure 3:
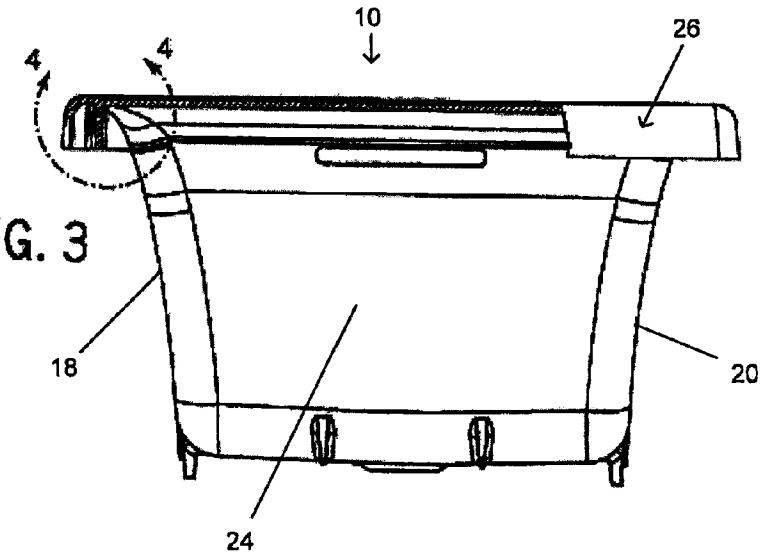
FIG. 3 is a cut-out, end elevation view of a bath tub embodying the invention.

Referring to FIG. 2, the rim 26 at the sides or ends of the tub 10 curls or curves down from the top of the bath tub 10 different vertical distances, or to different heights relative to a base plane, such as that including the floor or the basin bottom 16. In particular, the rim 26 at the end walls 22 and 24 extends downward farther than at the side walls 18 and 20. As seen in FIG. 2, the rim 26 on the side walls 18 and 20 curves down to a height, H2, off of the floor and the rim 26 on the end walls 22 and 24 curves down to a height, H1, off of the floor. H1 is also the height of the mounting platform 14 off of the floor. Thus, the rim 26 on the end walls 22 and 24 engages the mounting platform 14 and acts as a pedestal to support the tub 10 when the basin 14 is inserted into the opening in the mounting platform 12.

Figure 4:
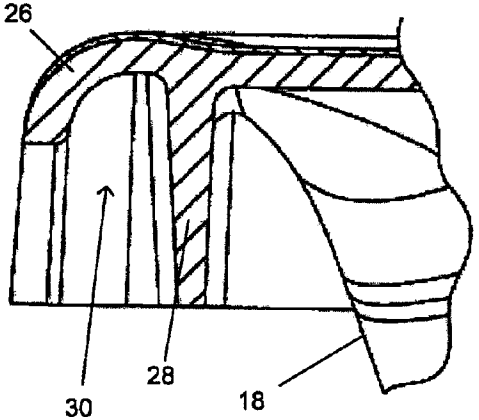
FIG. 4 is a detail view of a partition and a peripheral rim at one side of the bath tub.

The shorter rim surfaces along the side walls 18 and 20 create spaces between the top surface of the mounting platform 12 and the rim 26. As seen in FIGS. 2 and 4, the space 30 between the rim 26 on the side wall 18 and the top surface of the mounting platform 12 is large enough for fingers to fit in, and thereby allow a bather to grip the rim 26 surfaces on the sides 18 and 20 when entering or leaving the bath tub 10. Since the side rim surfaces are integrally formed with the side walls, these surfaces form integral grips on each side of the bath tub 10 to assist the bather into and out of the tub 10. As can be seen in FIG. 4, the gripping areas are formed by a smoothly contoured wall that curls downward a short distance so as to provide an ergonomic handle.

As shown in FIG. 2, in the described embodiment the grips run the full-length of the side walls 18 and 20, and thus the full-length of the basin 14. This is preferred to give the bather gripping surfaces along the entire length of the side walls 18 and 20, and to permit the bather to freely slide his or her hands along therealong when moving in and out of the tub or when shifting positions within the tub. However, it is within the scope of the invention to provide integral gripping surfaces at the sides of the basin 14 that extend less than the full-length thereof (with the partition wall(s) 28 being correspondingly shortened possibly), in which case some portion of the rim 26 could extend down to the height at the ends of the basin, or even to lower than at the basin, in which case the rim 26 would provide both the pedestal feature for supporting the tub as well as the integral gripping feature. Moreover, it should be noted that in this case multiple, short-length gripping surfaces could thus be provided at each side. Furthermore, it is also within the scope of the invention for such gripping features to be formed at the ends of the basin.

Referring now to FIG. 4, either a single, continuously extending partition wall 28, or multiple discrete-length partition walls 28 extend down from the rim 26 along each side of the bath tub 10 in the space between each of the side walls 18 and 20 and the free edge of the rim 26. As seen in FIG. 4, the partition wall 28 provides a surface for sealing the tub at the opening of the mounting platform 14, such as with a gasket, caulk or the like (not shown). By sealing the bath tub 10 along the partition wall on each side of the bath tub 10, water cannot splash over the rim 26 and leak down between the outside of the tub 10 and the mounting platform 12 into the opening in the mounting platform 12. Also, this prevents small objects and debris from falling down between the tub 10 and the mounting platform 12.

The partition wall(s) 28 may extend to and engage the top surface of the mounting platform 12 as seen in FIG. 4, and thus, may provide support for the tub 10 similar to the functioning of the rim 26 on the end walls 22 and 24 as previously described. In such a circumstance, the top surface of the mounting platform 12 may or may not extend to the side 18 of the tub 10. Alternatively, if the opening in the mounting platform 12 is of a greater dimension than the basin, the partition wall 28 may extend below the top surface of the mounting platform 12. In that circumstance, the bottom edge of the partition wall(s) 28 will not engage the top surface(s) of the mounting platform 12, and thus, the wall 28 will not act as a pedestal to support the tub 10. Even so, the outer side of the partition wall(s) 28 may engage the mounting platform 12 and provide one or more surfaces for sealing the tub 10 at the opening of the mounting platform, as previously described.

Moreover, the outer face of the partition wall(s) 28 may be finished to provide a smooth, aesthetic surface. As a bather grips the rim 26 on the side walls 18 and 20, the bather's fingers may contact the smooth, outer face of the partition walls rather than contacting the rough, outer surface of the side walls 18 and 20.

While there has been shown and described what is at present considered a preferred embodiment of the invention, various changes and modifications can be made therein without departing from the scope of the invention defined by the appended claims. Therefore, various alternatives and revised embodiments are contemplated as being within the scope of the following claims.

INDUSTRIAL APPLICABILITY

The invention provides a drop-in bath tub with a peripheral rim integrally forming hand-gripping areas for a bather to hold onto when entering and exiting the bath tub. Other portions of the rim integrally form surfaces for supporting the bath tub on a mounting surface so that that the hand-gripping areas are spaced from the mounting surface to accommodate the bathers hands.

What is claimed is:

1. A tub for bathing, comprising:

a basin including a bottom wall, upright side walls, an upright foot end wall, an upright head end wall, and a rim that extends down from the side walls and the end walls;

wherein first and second portions of the rim extend down to a first height from each of the end walls respectively to a substantially uniform height for a majority of a length of each of the end walls, and a third portion of the rim extends down to a second substantially uniform height for a majority of a length of at least one of the side walls;

wherein the first height is less than the second height; and wherein when the tub is mounted in an opening of a mounting platform having a generally planar, horizontal upper surface, the third portion of the rim is spaced uniformly above the upper surface of the mounting platform.

2. The tub of claim 1, wherein the basin includes a partition wall extending down from the rim between each of the side walls and a peripheral edge of the rim.

3. The tub of claim 2, wherein when the tub is mounted in the opening of the generally planar mounting platform, the partition wall engages the horizontal upper surface of the mounting platform.

4. The tub of claim 3, wherein the partition wall provides a sealing surface for sealing the tub with the mounting platform.

5. The tub of claim 1, wherein the first, second, and third portions of the rim of the tub also outward from the side walls to form a peripheral edge, and wherein a portion of the peripheral edge of the rim formed by the third portion is spaced above the upper surface of the mounting platform to define a gap therebetween for receiving a person's hand for gripping of the third portion of the rim.

6. A tub for bathing comprising:

a basin formed of a bottom wall, upright side walls, and upright end walls; and a rim extending from a top of the basin to a peripheral edge;

wherein when the tub is mounted in an opening of a generally planar mounting platform having a horizontal upper surface, the rim peripheral edge contacts the horizontal upper surface of the mounting platform at the end walls and is spaced above the horizontal upper surface of the mounting platform at at least one of the side walls.

7. The tub of claim 6, wherein the rim extends continuously about the top of the basin along the side walls and the end walls, and wherein the rim peripheral edge at the end walls is at a height that is closer to the basin bottom than it is at the side walls.

8. The tub of claim 7, wherein the rim curves downward in the direction from the top of the basin to the basin bottom as a single, continuous wall.

9. The tub of claim 8, wherein the rim forms curved handgrips at the side walls of the basin.

10. The tub of claim 6, further comprising a partition wall extending from the rim between each of the basin side walls and the rim peripheral edge, wherein the partition wall extends to a height that is closer to the basin bottom than at least a portion of the rim peripheral edge.

11. The tub of claim 6, wherein the peripheral edge of the rim is configured to provide a handgrip, the rim peripheral edge being spaced above the horizontal upper surface of the mounting platform to define a gap therebetween for receiving a person's hand for gripping the rim.

12. A tub for bathing comprising:

a basin formed of a bottom wall, upright side walls, and upright end walls;

a rim extending from a top of the basin to a peripheral edge;

a partition wall extending from the rim between the basin side walls and the rim peripheral edge;

wherein first and second portions of the rim extend down to a first height from each of the end walls respectively to a substantially uniform height for a majority of a length of each of the end walls, and a third portion of the rim extends down to a second substantially uniform height for a majority of a length of at least one of the side walls; and wherein when the tub is mounted in an opening of a generally planar mounting platform having a horizontal upper surface, the rim peripheral edge contacts the horizontal upper surface of the mounting platform at the end walls and is spaced from the horizontal upper surface of the mounting platform at at least one of the side walls.

13. The tub of claim 12, wherein the partition wall and the rim are a unitary structure.

14. The tub of claim 13, wherein the rim extends continuously about the top of the basin along the side walls and the end walls.

15. The tub of claim 14, wherein the rim peripheral edge at the end walls is closer to the basin bottom than at the side walls.

16. The tub of claim 15, wherein the rim curves downward in the direction from the top of the basin to the basin bottom as a single, continuous wall.

17. The tub of claim 16, wherein the rim forms curved handgrips at the side walls of the basin.

18. The tub of claim 12, wherein the partition wall is configured to engage a mounting surface of the generally planar mounting platform when the tub is mounted in the generally planar mounting platform.

19. The tub of claim 12, wherein the peripheral edge of the rim is configured to provide a handgrip, the rim peripheral edge being spaced above the horizontal upper surface of the mounting platform to define a gap therebetween for receiving a person's hand for gripping the rim.

* * * * *